US009222201B2

(12) United States Patent
Patton et al.

(10) Patent No.: US 9,222,201 B2
(45) Date of Patent: Dec. 29, 2015

(54) PROCESSES FOR PREPARING CARBON FIBERS USING SULFUR TRIOXIDE IN A HALOGENATED SOLVENT

(71) Applicant: Dow Global Technologies LLC, Midland, MI (US)

(72) Inventors: Jasson T. Patton, Midland, MI (US); Bryan E. Barton, Midland, MI (US); Mark T. Bernius, Bowling Green, OH (US); Xiaoyun Chen, Midland, MI (US); Eric J. Hukkanen, Midland, MI (US); Christina A. Rhoton, Beaverton, MI (US); Zenon Lysenko, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/413,456

(22) PCT Filed: Jul. 3, 2013

(86) PCT No.: PCT/US2013/049196

§ 371 (c)(1),
(2) Date: Jan. 8, 2015

(87) PCT Pub. No.: WO2014/011462

PCT Pub. Date: Jan. 16, 2014

(65) Prior Publication Data

US 2015/0197878 A1 Jul. 16, 2015

Related U.S. Application Data

(60) Provisional application No. 61/670,802, filed on Jul. 12, 2012.

(51) Int. Cl.

| | |
|---|---|
| ***D01F 9/21*** | (2006.01) |
| ***D06M 11/55*** | (2006.01) |
| ***D01F 9/14*** | (2006.01) |
| *D06M 101/20* | (2006.01) |

(52) U.S. Cl.
CPC .. *D01F 9/21* (2013.01); *D01F 9/14* (2013.01); *D06M 11/55* (2013.01); *D06M 2101/20* (2013.01)

(58) Field of Classification Search
CPC ..... D06M 11/55; D06M 2101/20; D01F 9/21; D01F 9/14
USPC ..... 423/447.4
See application file for complete search history.

(56) References Cited

U.S. PATENT DOCUMENTS

| | | | | |
|---|---|---|---|---|
| 4,070,446 | A | 1/1978 | Horikiri et al. | |
| 4,209,592 | A * | 6/1980 | Akiyama | B01J 39/20 521/33 |
| 4,902,493 | A * | 2/1990 | Walles | C01B 17/69 422/12 |
| 5,280,082 | A | 1/1994 | Bedell et al. | |
| 5,523,327 | A | 6/1996 | Song et al. | |
| 5,721,279 | A | 2/1998 | Foster et al. | |
| 2013/0214442 | A1 * | 8/2013 | Naskar | D04H 1/4242 264/29.2 |

FOREIGN PATENT DOCUMENTS

WO 9203601 A2 3/1992

OTHER PUBLICATIONS

Hunt, et al., Patterned Functional Carbon Fibers from Polyethylene, Adv. Mater. 2012; 24: 2386-2389.*

Postema, et al. Amorphous Carbon Fibres from Linear Low Density Polyethylene. Journal of Materials Science. (1990) vol. 25, No. 10, pp. 4216-4222.

Penning, et al. The effect of diameter on the mechanical properties of amorphous carbon fibres from linear low density polyethylene. Polymer Bulletin. (1991) vol. 25, No. 3, pp. 405-412.

Ravi, et al. Conversion of highly-ordered polyethylene fiber into carbon fiber. Processing and Fabrication of Advanced Materials for High Temperature Applications—II. Proceedings of a Symposium. (1993) pp. 475-485.

Zhang, et al. Carbon Fibers from Polyethylene-Based Precursors. Materials and Manufacturing Processes. (1994) vol. 9, No. 2, pp. 221-235.

Leon y Leon, et al. Low Cost Carbon Fiber From Non-Acrylic Based Precursors: Polyethylene. International SAMPE Technical Conference. (2002) vol. 34, pp. 506-519.

Karacan, et al. Use of Sulfonation Procedure for the Development of Thermally Stabilized Isotactic Polypropylene Fibers Prior to Carbonization. Journal of Applied Polymer Science. (2012) vol. 123, pp. 234-245.

* cited by examiner

*Primary Examiner* — Daniel C McCracken
(74) *Attorney, Agent, or Firm* — Christopher A. Johnson

(57) ABSTRACT

Disclosed here are processes for preparing carbonized polymers (preferably carbon fibers), comprising sulfonating a polymer with a sulfonating agent that comprises $SO_3$ dissolved in a solvent to form a sulfonated polymer; treating the sulfonated polymer with a heated solvent, wherein the temperature of the solvent is at least 95° C.; and carbonizing the resulting product by heating it to a temperature of 500-3000° C. Carbon fibers made according to these methods are also disclosed herein.

18 Claims, 1 Drawing Sheet

| Example | Polymer | Tenacity (grams/ denier) | Sulfonation Conditions | Hot Solvent treatment | Carbonization Stress (MPa) | Carbon Fiber Properties | | | |
|---|---|---|---|---|---|---|---|---|---|
| | | | | | | Diameter (microns) | Young's Modulus (GPa) | Tensile Strength (GPa) | Strain (%) |
| 1-Control | Ethylene/ 1-octene | 2 | $SO_3$/EDC, 4 hrs, RT | None | N/A | Too weak to carbonize | | | |
| 2-Control | Ethylene/ 1-octene | 2 | $SO_3$/EDC, 5 hrs, RT | None | N/A | Too weak to carbonize | | | |
| 3-Control | Ethylene/ 1-octene | 2 | $SO_3$/EDC, 4 hrs, RT | 120 °C EDC, 1 hr | N/A | Too weak to carbonize | | | |
| 4 | Ethylene/ 1-octene | 2 | $SO_3$/EDC, 0.5 hr, RT | $H_2SO_4$ for 1hr at 100 °C then 1hr At 120 °C | 4.5 | 15.0 | 56 | 1.06 | 1.84 |
| 5 | Ethylene/ 1-octene | 2 | $SO_3$/EDC, 0.5 hr, RT | $H_2SO_4$ for 1hr at 100 °C then 1hr At 120 °C | 9 | 14.4 | 56 | 0.83 | 1.43 |
| 6 | Ethylene/ 1-octene | 5.9 | $SO_3$/EDC, 0.5 hr, RT | $H_2SO_4$ for 0.5 hr at 120 °C | 9 | 15.2 | 49 | 0.51 | 1.03 |
| 7 | | | | $H_2SO_4$ for 0.75 hr at 120 °C | 9 | 15.9 | 63 | 0.65 | 1.02 |
| 8 | | | | $H_2SO_4$ for 1 hr at 120 °C | 9 | 15.7 | 66 | 0.70 | 1.06 |
| 9 | Ethylene/ 1-butene | 1.8 | $SO_3$/EDC, 10 min, RT | $H_2SO_4$ for 10 min at 120 °C | 0.8 | 23.2 | 32 | 0.52 | 1.65 |
| 10 | Ethylene/ 1-butene | 1.8 | | | 1.7 | 23.6 | 30 | 0.46 | 1.52 |
| 11-comparison | Ethylene/ 1-octene | 2 | $H_2SO_4$ for 4 hr at 120 °C | | 4.5 | 12.2 | 56 | 0.79 | 1.39 |
| 12-comparsion | Ethylene/ 1-octene | 5.9 | | | 10 | 15.0 | 73 | 0.95 | 1.28 |

EDC is ethylene dichloride; RT = room temperature

PROCESSES FOR PREPARING CARBON FIBERS USING SULFUR TRIOXIDE IN A HALOGENATED SOLVENT

CROSS REFERENCE TO RELATED APPLICATIONS

This application is a 35 USC §371 national phase filing of PCT/US2013/049196 filed Jul. 3, 2013, which claims the benefit of U.S. Application No. 61/670,802, filed Jul. 12, 2012.

STATEMENT OF GOVERNMENT INTEREST

This invention was made under a NFE-10-02991 between The Dow Chemical Company and UT-Batelle, LLC, operating and management Contractor for the Oak Ridge National Laboratory operated for the United States Department of Energy. The Government has certain rights in this invention.

BACKGROUND OF THE INVENTION

The world production of carbon fiber in 2010 was 40 kilo metric tons (KMT) and is expected to grow to 150 KMT in 2020. Industrial-grade carbon fiber is forecasted to contribute greatly to this growth, wherein low cost is critical to applications. The traditional method for producing carbon fibers relies on polyacrylonitrile (PAN), which is solution-spun into fiber form, oxidized and carbonized. Approximately 50% of the cost is associated with the cost of the polymer itself and solution-spinning.

In an effort to produce low cost industrial grade carbon fibers, various groups studied alternative precursor polymers and methods of making the carbon fibers. Many of these efforts were directed towards the sulfonation of polyethylene and the conversion of the sulfonated polyethylene to carbon fiber. But the methods and resulting carbon fibers are inadequate for at least two reasons. First, the resulting carbon fibers suffer from inter-fiber bonding. Second, the resulting carbon fibers have physical properties that are inadequate.

For example, U.S. Pat. No. 4,070,446 described a process of sulfonating high density polyethylene using chlorosulfonic acid (Examples 1 and 2), sulfuric acid (Examples 3 and 4), or fuming sulfuric acid (Example 5). Example 5 in this patent used 25% fuming sulfuric acid at 60° C. for two hours to sulfonate high-density polyethylene (HDPE), which was then carbonized. When the inventors used this method to sulfonate linear low density polyethylene (LLDPE), the resulting fibers suffered from inter-fiber bonding, and poor physical properties. Consequently, this method was judged inadequate.

In Materials and Manufacturing Processes Vol. 9, No. 2, 221-235, 1994, and in Processing and Fabrication of Advanced Materials for High Temperature Applications-II; Proceedings of a Symposium, 475-485, 1993 Zhang and Bhat reported a process for the sulfonation of ultra-high molecular weight (UHMW) polyethylene fibers using only sulfuric acid. Both papers report the same starting Spectra fibers and the same sulfonation process. The fibers were wrapped on a frame and immersed in 130-140° C. sulfuric acid and the temperature was slowly raised up to 200° C. Successful sulfonation times were between 1.5 and 2 hours. The fibers were removed at discrete intervals and washed with tap water, dried in an oven at 60° C. and carbonized in an inert atmosphere at 1150° C. Although good mechanical properties of the carbon fibers were obtained in this method, an expensive gel-spun polymer fiber was utilized and prolonged reaction times were used. As a result, we judge this method to be inadequate.

In Polymer Bulletin, 25, 405-412, 1991 and Journal of Materials Science, 25, 4216-4222, 1990 A. J. Pennings et al. converted a linear low-density polyethylene to carbon fiber by immersing fibers into room-temperature chlorosulfonic acid for 5-20 hours. This process would be prohibitively expensive from an industrial prospective due to the high cost of chlorosulfonic acid as well as the long reaction times.

In 2002, Leon y Leon (International SAMPE Technical Conference Series, 2002, Vol. 34, pages 506-519) described a process of sulfonating LLDPE fibers (d=0.94 g/mL) with warmed, concentrated $H_2SO_4$. A two-stage sulfonated system was also described, wherein "relative to the first stage, the second sulfonation stage involves: (a) longer residence time at a similar temperature (or a larger single-stage reactor at a single temperature); or (b) a slightly higher acid concentration at a higher temperature." See page 514. Specific times and temperatures were not disclosed. In this reference tensile properties of the resulting carbon fibers were determined differently than is convention. Cross-sectional areas used for tensile testing were "calculated from density (by pycnometry) and weight-per-unit-length measurements" (pg 516, Table 3-pg 517). However, ASTM method D4018 describes that diameters should be measured directly by microscopy. After adjusting the reported tensile properties using the microscopy-measured diameters (Table 2, pg 517) new values were determined as follows:

| Trial # | Est. diameters | Measured diameters | Reported Young's Modulus (GPa) | Reported Tensile Strength (GPa) | Adjusted Young's Modulus (GPa) | Adjusted Tensile Strength (GPa) | Strain (%) |
|---|---|---|---|---|---|---|---|
| 22 | 9-10 | 14.3 | 105 | 0.903 | 51 | 0.44 | 0.86 |
| 26 | 9-10 | 13.2 | n.d. | 1.54 | n.d. | 0.89 | NA |
| 27 | 9-10 | 14.0 | 134 | 1.34 | 68 | 0.68 | 1.0 |

The methods disclosed in this reference produce carbon fibers having inadequate tensile strength and modulus.

In spite of these efforts, adequate methods of converting polyethylene based polymer fibers to carbonized polymers are still needed. Thus, disclosed herein are methods of making carbonized polymers (preferably carbon fibers) from a polymer, the methods comprising the sulfonation of the polymer to form a sulfonated polymer, subsequent hot solvent treatment of the sulfonated fibers, followed by carbonization of the polymer. These methods result in industrial grade carbonized polymers (preferably carbon fibers) having superior properties, when compared to those that were not treated with a hot solvent. These new methods work with all sulfonation methods.

SUMMARY OF THE INVENTION

In one aspect, disclosed herein are processes for preparing carbonized polymers, the processes comprising:

a) sulfonating a polymer with a sulfonating agent that comprises $SO_3$ dissolved in a halogenated solvent to form a sulfonated polymer;

b) treating the sulfonated polymer with a heated solvent, wherein the temperature of the solvent is at least 95° C.; and c) carbonizing the resulting product by heating it to a temperature of 500-3000° C.

The compounds and processes disclosed herein utilize polymeric starting materials. The polymeric starting materials may be in the form of fabrics, sheets, fibers, or combinations thereof. In a preferred embodiment, the polymeric starting material is in the form of a fiber and the resulting carbonized polymer is a carbon fiber.

In another aspect, disclosed herein are carbon fibers made according to the aforementioned processes.

BRIEF DESCRIPTION OF THE DRAWINGS

FIG. 1 is a table summarizing data for various control and experimental carbon fibers.

DETAILED DESCRIPTION

As mentioned above, the sulfonating agent comprises $SO_3$ dissolved in a halogenated solvent. Typically, $SO_3$ gas is bubbled into (or above) or otherwise dissolved from liquid $SO_3$ or solid or polymer $SO_3$ into a halogenated solvent. But, if desired, $SO_3$ gas in combination with one or more other gases may be used. The exact method of combining the $SO_3$ gas and the solvent is well within the abilities of a person having ordinary skill in the art.

Suitable halogenated solvents contain at least one halogen (selected from the group consisting of F, Cl, Br and I) and have one to 30 carbons. If desired, a combination of two or more halogenated solvents may be used. Examples include fluorocarbons, chlorocarbons, bromocarbons, chlorofluorocarbons, bromofluorocarbons, or combinations thereof. Perfluoro and perchloro solvents and solvents wherein all hydrogens are replaced with a combination of bromo, chloro and/or fluoro groups are also suitable. In one embodiment, the solvent is a fluorocarbon, a bromocarbon. a chlorocarbon, a chlorofluorocarbon, or combinations thereof. Specific examples of suitable solvents include $Br_2ClFC$; $Br_3FC$; $BrCl_2FC$; 1-bromo-1,1-dichlorotrifluoroethane; 1,2-dibromotetrafluoroethane; pentachlorofluoroethane; 1,2-difluorotetrachloroethane; 1,1,1-trichlorofluoromethane; methylene chloride; 1,2-dibromomethane; 1,2-dichloroethane; 1,1,2,2-tetrachloroethane; and/or mixtures thereof. Chlorine containing solvents are particularly preferred, and of these, 1,2-dichloroethane is a preferred solvent. And while it is possible non-halogenated solvents can be used or combined with halogenated solvents, halogenated, or otherwise inert solvents are preferred.

The concentration of the $SO_3$ in the halogenated solvent may be from 0.01 to 24 moles per liter. More preferably, the concentration is 0.1-14 moles per liter. Still more preferably, the concentration is less than 10 moles per liter. More preferably, the concentration is 0.15 to 5 moles/liter. Still more preferably, the concentration is 0.5 to 4 moles/liter.

The $SO_3$ in the halogenated solvent may be added to the reaction mixture dropwise, portionwise, or all at once.

The $SO_3$ in the halogenated solvent may be added to the polymer or the polymer may be added to the $SO_3$ in the halogenated solvent.

The $SO_3$ added to the halogenated solvent to make the desired solution may come from a variety of sources, liquid $SO_3$, gaseous $SO_3$, or even $SO_3$:lewis base adducts such as DMSO:$SO_3$, DMF:$SO_3$, Ether:$SO_3$. If desired, the halogenated solvent may include one or more additional solvents, such as hydrocarbons, ethers, sulfoxides or amides. More specifically, $C_4$-$C_8$ hydrocarbons, $C_2$-$C_6$ alkyl-O—$C_2$-$C_6$ alkyl, DMF or DMSO may be used.

The sulfonation reaction is typically carried out a temperature of about 0-140° C. More preferably, the temperature is 0-90° C. More preferably, the reaction temperature is 10-80° C. Still more preferably, the reaction temperature is 15-60° C. Even more preferably, the reaction temperature is 20-35° C.

Sulfonation reaction times are from 5 seconds to 16 hours. More preferably, the reaction times are from 1 minute to 8 hours. Still more preferably, the reaction time is less than 6 hours. Even more preferably, the reaction time is 2 minutes to 4 hours or 5 minutes to 1 hour. Of course, it is known in the art that the sulfonation reaction time is affected by the fiber diameter (if a fiber is being used), % crystallinity of the polymer r, identity and concentration of the co-monomer(s)—if present, the density of the polymer, the concentration of double bonds in the polymer, porosity of the polymer, the sulfonation temperature, and the concentration of the sulfonating reagent. The optimization of sulfonation temperature, sulfonating reagent concentration and addition rate, and reaction time are within the ability of one having skill in the art.

The sulfonation reaction is normally run at ambient/atmospheric pressure. But if desired, pressures greater or lesser than ambient pressure may be used.

One method of decreasing sulfonation reaction time is to swell the polymer with suitable solvent before or during the sulfonation reaction. In one embodiment, a polymer could be treated with a suitable swelling solvent prior to treatment with an $SO_3$ solution of halogenated solvent. Alternatively, the polymer could be swelled with suitable solvent during the sulfonation step with an emulsion, solution, or otherwise combination of swelling agent and sulfonating agent. An additional benefit of performing a swelling step or steps before or during sulfonation is a more uniform sulfur distribution across the polymer and consequently enhanced processing conditions and properties.

After the polymer is sulfonated, it is treated with a heated solvent. Acceptable temperatures are at least 95° C. More preferably, at least 100° C. Still more preferably at least 105° C. or 110° C. Even more preferably, at least 115° C. Most preferred is at least 120° C. The maximum temperature is the boiling point of the solvent or 180° C. In one embodiment, the temperature of the solvent is 100-180° C. Alternatively, the temperature of the solvent is 120-180° C. While temperatures below 120° C. can be used, the reaction rate is slower and thus, less economical as the throughput of the reaction decreases.

In one embodiment, the preferred solvents are polar and/or protic. Examples of protic solvents include mineral acids, water, and steam. $H_2SO_4$ is a preferred protic solvent. In one embodiment, the heated solvent is $H_2SO_4$ at a temperature of 100-180° C. Still more preferably, the heated solvent is $H_2SO_4$ at a temperature of 120-160° C.

Alternatively, the heated solvent may be a polar solvent. Examples of suitable polar solvents include DMSO, DMF, NMP, halogenated solvents of suitable boiling point or combinations thereof. Preferably, the heated solvent is a polar solvent at a temperature of 120-160° C.

It should be understood that when polymer fibers are being used, the nature of the polymer fibers, their diameter, tow size, % crystallinity of the fibers, the identity and concentration of the co-monomer(s)—if present, and the density of the polymer fiber, will impact the reaction conditions that are used. Likewise, the temperature of the heated solvent used in the heated solvent treatment and the concentration of the $H_2SO_4$ (if $H_2SO_4$ is used) also depends on the nature of the polymer fibers, their diameter, tow size, and the % crystallinity of the fibers.

Once the sulfonation reaction is completed (which means 1%-100% of the polymer was sulfonated) (as determined using thermogravimetric analysis (TGA), the polymer may be degassed and optionally washed with one or more solvents. If the polymer is degassed, any method known in the art may be used. For example, the polymer may be subjected to a vacuum or sprayed with a pressurized gas.

If the polymer is washed, the washing encompasses rinsing, spraying or otherwise contacting the polymer with a solvent or combination of solvents, wherein the solvent or combination of solvents is at a temperature of from −100° C. up to 200° C. Preferred solvents include water, $C_1$-$C_4$ alcohols, acetone, dilute acid (such as sulfuric acid), halogenated solvents and combinations thereof. In one embodiment, the polymer s is washed with water and then acetone. In another embodiment, the polymer is washed with a mixture of water and acetone. Once the polymer is washed, it may be blotted dry, air dried, heated using a heat source (such as a conventional oven, a microwave oven, or by blowing heated gas or gases onto the polymer), or combinations thereof.

The polymer used herein consist of homopolymers made from polyethylene, polypropylene, polystyrene, and polybutadiene, or comprise a copolymer of ethylene, propylene, styrene and/or butadiene. Preferred copolymers include ethylene/octene copolymers, ethylene/hexene copolymers, ethylene/butene copolymers, ethylene/propylene copolymers, ethylene/styrene copolymers, ethylene/butadiene copolymers, propylene/octene copolymers, propylene/hexene copolymers, propylene/butene copolymers, propylene/styrene copolymers, propylene butadiene copolymers, styrene/octene copolymers, styrene/hexene copolymers, styrene/butene copolymers, styrene/propylene copolymers, styrene/butadiene copolymers, butadiene/octene copolymers, butadiene/hexene copolymers, butadiene/butene copolymers, butadiene/propylene copolymers, butadiene/styrene copolymers, or a combination of two or more thereof. Homopolymers of ethylene and copolymers comprising ethylene are preferred. The polymers used herein can contain any arrangement of monomer units. Examples include linear or branched polymers, alternating copolymers, block copolymers (such as diblock, triblock, or multi-block), terpolymers, graft copolymers, brush copolymers, comb copolymers, star copolymers or any combination of two or more thereof.

The polymer fibers used herein (when fibers are used) can be of any cross-sectional shape, such as circular, star-shaped, hollow fibers, triangular, ribbon, etc. Preferred polymer fibers are circular in shape. Additionally, the polymer fibers can be produced by any means known in the art, such as melt-spinning (single-component, bi-component, or multi-component), solution-spinning, electro-spinning, film-casting and slitting, spun-bond, flash-spinning, and gel-spinning. Melt spinning is the preferred method of fiber production.

It must be emphasized that the treatment with a heated solvent is vital to the inventions disclosed herein. As shown below, the heated solvent treatment significantly improves the physical properties of the resulting carbon fiber, when compared to carbon fibers that were not treated with a heated solvent. Without wishing to be bound to a particular theory, it is believed that the heated solvent treatment allows the fibers to undergo crosslinking, which improves their physical properties, while inhibiting the ability of the fibers to fuse or undergo inter-fiber bonding.

And as previously mentioned, in some embodiments, the sulfonation reaction is not run to completion. Rather, after the reaction is 1-99% complete (or more preferably 40-99% complete), the sulfonation reaction is stopped and then the sulfonation is completed in the hot solvent treatment step (when the hot solvent is a mineral acid, such as concentrated sulfuric acid.) If desired, the sulfonation, the treatment with a heated solvent and/or the carbonization may be performed when the polymer fiber (also called "tow") is under tension. It is known in the carbon fiber art that maintaining tension helps to control the shrinkage of the fiber. It has also been suggested that minimizing shrinkage during the sulfonation reaction increases the tensile properties of the resulting carbon fiber.

Without wishing to be bound by a particular theory, it is believed that the sulfonic acid groups within sulfonated polyethylene fibers undergo a thermal reaction at ca. 145° C. (onset occurring around 120-130° C.) evolving $SO_2$ and $H_2O$ as products while generating new carbon-carbon bonds within the polymer. This was verified using Near-Edge X-Ray Absorption Fine Structure (NEXAFS) spectroscopy, which showed that heating sulfonated polyethylene fibers results in a decrease in C═C bonds and an increase in C—C single bonds. This result is consistent with the formation of new bonds between previously unbonded C atoms at the expense of C—C double bonds. The addition of solvent separates the individual filaments and prevents filament fusion. See the scheme below, which illustrates the generic chemical transformation occurring during the entire process. It should be understood by one skilled in the art that the variety and complexity of other functional groups present at all steps and have been omitted here for the sake of clarity.

Scheme 1. The generic chemical process of the hydrocarbon reacting with $SO_3$ generating a polyacetylene-like polymer with sulfonic acid groups, a subsequent thermal step cross-linking the individual polymer chains, and dehydrogenation at elevated temperatures resulting in the desired carbonized polymer.

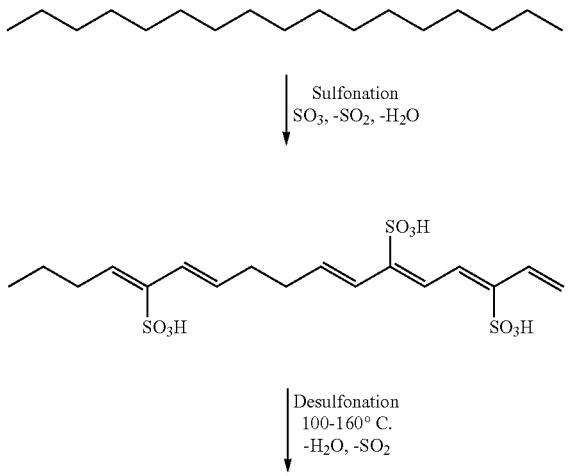

-continued

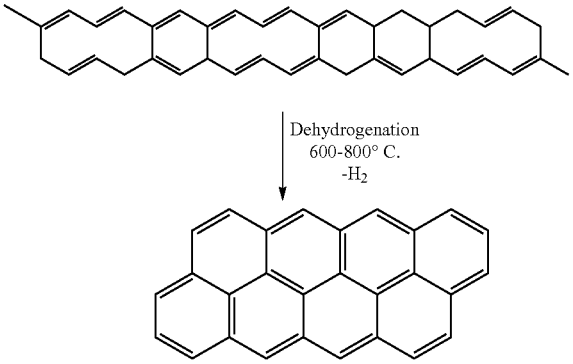

It must be emphasized that simply heating sulfonated fibers in an oven resulted in a high degree of fiber-fusion, wherein different fibers fuse or otherwise aggregate; such fused fibers tend to be very brittle and to have poor mechanical properties. In contrast, the treatment of sulfonated polymer fibers with a heated solvent results in fibers having significantly less fiber-fusion. Such fibers have improved tensile strength and higher elongation-to-break (strain) values. It is believed that the role of the solvent is to minimize the inter-fiber hydrogen bonding interactions between the surface sulfonic acid groups which thereby prevents inter-fiber cross-linking and fiber-fusion during the hot solvent treatment step. An alternative hypothesis employs the heated solvent to remove low molecular weight sulfonated polymer from the polymer fibers. Without removing this inter-fiber byproduct (i.e., the low molecular weight sulfonated polymer), heat treatment imparts similar cross-linking and ultimately creates the fusion of fibers.

It is possible that the sulfonation reaction will not go to completion, which (as is known in the art), results in hollow fibers, when fibers are used as the starting material. In such cases, using hot sulfuric acid in the hot solvent treatment will continue the sulfonation reaction and drive it towards completion, while the thermal reaction is also occurring. In one embodiment of this invention, one could produce hollow carbon fibers from this process by reducing the amount of time in the sulfonation chamber, the hot sulfuric acid bath, or both, while still retaining the advantage of producing non-fused fibers. If desired, adjusting the relative amounts of sulfonation performed in the sulfonation reaction and the hot solvent treatment can be used to alter the physical properties of the resulting carbon fibers.

If desired, the sulfonation, the treatment with a heated solvent and/or the carbonization may be performed when the polymer is under tension. The following discussion is based on the use of a polymer fiber (also called "tow"). It is known in the carbon fiber art that maintaining tension helps to control the shrinkage of the fiber. It has also been suggested that minimizing shrinkage during the sulfonation reaction increases the modulus of the resulting carbon fiber.

When using $SO_3$ in a halogenated solvent to perform the sulfonation reaction, it was discovered that the polymer fiber could be kept under a tension of up to 22 MPa, (with tensions of up to 16.8 MPa being preferred) the treatment with a heated solvent could be conducted while the polymer fiber was under a tension of up to 25 MPa, and carbonization could be conducted while the polymer fiber was under a tension of up to 14 MPa (with tensions of up to 5.3 MPa being preferred). In one embodiment, the process was conducted wherein at least one of the three aforementioned steps was conducted under tension. In a more preferred embodiment, the sulfonation, the treatment with a heated solvent, and the carbonization are performed while the polymer fiber is under a tension greater than 1 MPa. As will be readily appreciated, it is possible to run the different steps at different tensions. Thus, in one embodiment, the tension during the carbonization step differs from that in the sulfonation step. It should also be understood that the tensions for each step also depend on the nature of the polymer, the size, and tenacity of the polymer fiber. Thus, the above tensions are guidelines that may change as the nature and size of the fibers change.

The carbonization step is performed by heating the sulfonated and heat treated fibers. Typically, the fiber is passed through a tube oven at temperatures of from 500-3000° C. More preferably, the carbonization temperature is at least 600° C. In one embodiment, the carbonization reaction is performed at temperature in the range of 700-1,500° C. The carbonization step may be performed in a tube oven in an atmosphere of inert gas or in a vacuum. One of skill in the art will appreciate that if desired, activated carbon fibers may be prepared using the methods disclosed herein.

In one preferred embodiment, the processes comprise:

a) sulfonating polyethylene containing polymer with $SO_3$ in a halogenated solvent, wherein the sulfonation reaction is performed at a temperature of from 0-90° C. to form a sulfonated polymer;

b) treating the sulfonated polymer with a heated solvent, wherein the temperature of the solvent is 100-180° C.; and c) carbonizing the resulting product by heating it to a temperature of 500-3000° C.;

wherein at least one of steps a), b) and c) is performed while the polymer is under a tension of up to 14 MPa.

In this preferred embodiment, the heated solvent is DMSO, DMF, or a mineral acid; and/or the polyethylene containing polymer is a polyethylene homopolymers or polyethylene copolymers that comprise ethylene/octene copolymers, ethylene/hexene copolymers, ethylene/butene copolymers, ethylene/propylene copolymers, ethylene/styrene copolymers, ethylene/butadiene copolymers, or a combination of two or more thereof, and/or halogenated solvent is a chlorocarbon, and/or steps a), b) and c) are performed while the polymer is under a tension greater than 1 MPa.

Even more preferably, in this preferred embodiment, the protic solvent is a mineral acid that is concentrated sulfuric acid at a temperature of 115-160° C.

Also disclosed herein are carbon fibers made according to any of the aforementioned process.

In the following examples, tensile properties (young's modulus, tensile strength, % strain (% elongation at break)) for single filaments (fibers) were determined using a dual column Instron model 5965 following procedures described in ASTM method C1557. Fiber diameters were determined with both optical microscopy and laser diffraction before fracture.

Example 1

Control

A copolymer of ethylene and 1-octene (0.33 mol %, 1.3 wt %) having $M_w$=58,800 g/mol and $M_w/M_n$=2.5 was spun into a continuous tow of fibers. The fibers had diameter of 15-16 microns, a tenacity of 2 g/denier, and crystallinity of ~57%. A 1 meter sample of 3300 fibers was tied through the glass apparatus and placed under 1000 g tension (17 MPa). The fibers were then treated at room temperature with a 1.9 M $SO_3$/1,2-dichloroethane solution for 4 hours, washed with 1,2-dichloroethane, water, acetone, and then dried. TGA analysis verified that the fibers were completely sulfonated, however the fibers were too weak to handle or carbonize.

Example 2

Control

The same polymer fibers were used as in example 1. A 1 meter sample of 3300 fibers was tied through the glass apparatus and placed under 1000 g tension (17 MPa). The fibers were then treated at room temperature with a 1.9 M $SO_3$/1,2-dichloroethane solution for 5 hours. The fibers were then washed with 1,2-dichloroethane, a 5% vol MeOH/1,2-dichloroethane solution, acetone, and then dried. TGA analysis verified that the fibers were completely sulfonated, however the fibers were too weak to handle or carbonize.

Example 3

1,2-dichloroethane heat treatment

The same polymer fibers were used as in example 1. A 1 meter sample of 3300 fibers was tied through the glass apparatus and placed under 500 g tension (13 MPa). The fibers were then treated at room temperature with a 1.9 M $SO_3$/1,2-dichloroethane solution for 4 hours. The fibers were then washed with 1,2-dichloroethane and 1,1,2,2-tetrachloroethane was added. The fibers were then heated to 120° C. with 40 g tension (~0.7 MPa) and held at temperature for 1 hour. After cooling, the fibers were washed with water and acetone and dried. TGA analysis verified that the fibers were completely sulfonated, however the fibers were too weak to handle or carbonize.

Example 4

Experimental

The same polymer fibers were used as in example 1. A 1 meter sample of 3300 fibers was tied through the glass apparatus and placed under 200 g tension (3.3 MPa). The fibers were then treated at room temperature with a 1.9 M $SO_3$/1,2-dichloroethane solution for 30 minutes. After this point in the reaction TGA analysis indicated that ~10% of the polyethylene had reacted. The fibers were then washed with 1,2-dichloroethane. The fibers were then treated with 96% sulfuric acid for 1 hr at 100° C. and 1 hr at 120° C. The fibers were then cooled to room temperature, washed with 50% sulfuric acid, water, acetone and then dried. TGA analysis verified that the fibers were completely sulfonated. The sulfonated fiber tow was then placed into a tube furnace under 250 g (4.5 MPa) tension and heated to 1150° C. over 5 hr under nitrogen. The tensile properties resulting from an average of ~15 filaments are provided in FIG. 1.

Example 5

Experimental

The same sulfonated fiber produced from Example 4 was then placed into a tube furnace under 500 g (9 MPa) tension and heated to 1150° C. over 5 hr under nitrogen. Individual filaments from this tow were tensile tested. The tensile properties resulting from an average of ~15 filaments are provided in FIG. 1.

Examples 6-8

Experimental

The starting fibers as used as in Example 1 were hot drawn to diameters of 13-15 microns and tenacity of 5.9 g/denier, and crystallinity of ~67%. A 1 meter sample of 3300 fibers was tied through the glass apparatus and placed under 400 g tension (8 MPa). The fibers were then treated at room temperature with a 1.9 M $SO_3$/1,2-dichloroethane solution for 30 minutes.

The fibers were then washed with 1,2-dichloroethane. The fibers were then treated with 96% sulfuric acid at 120° C. for the following times:

Example 6-30 minutes
Example 7-45 minutes
Example 8-60 minutes

The fibers were then cooled to room temperature, washed with 50% sulfuric acid, water, acetone and then dried. TGA analysis verified that the fibers were completely sulfonated. The sulfonated fiber tow was then placed into a tube furnace under 500 g (~10 MPa) tension and heated to 1150° C. over 5 hr under nitrogen. Individual filaments from this tow were tensile tested. The tensile properties resulting from an average of ~15 filaments are provided in FIG. 1.

Example 9

Experimental

A copolymer of ethylene and 1-butene (3.6 mol %, 7 wt %) having $M_w$=60,500 g/mol and $M_w/M_n$=2.7 was spun into a continuous tow of fibers. The fibers had diameter of ~16.5 microns, a tenacity of 1.8 g/denier, and crystallinity of ~45%. A 1 meter sample of 3300 fibers was tied through the glass apparatus and placed under 40 g tension (~0.5 MPa). The fibers were then treated at room temperature with a 1.9 M $SO_3$/1,2-dichloroethane solution for 10 minutes. The fibers were then washed with 1,2-dichloroethane. The fibers were then treated with 96% sulfuric acid for 10 minutes at 120° C. The fibers were then cooled to room temperature, washed with 50% sulfuric acid, water, acetone and then dried. TGA analysis verified that the fibers were completely sulfonated. The sulfonated fiber tow was then placed into a tube furnace under 50 g (~0.8 MPa) tension and heated to 1150° C. over 5 hr under nitrogen. Individual filaments from this tow were tensile tested. The tensile properties resulting from an average of ~15 filaments are provided in FIG. 1.

Example 10

Experimental

The same sulfonated fiber produced from Example 9 was then placed into a tube furnace under 100 g (~1.7 MPa) tension and heated to 1150° C. over 5 hr under nitrogen. Individual filaments from this tow were tensile tested. The tensile properties resulting from an average of ~15 filaments are provided in FIG. 1.

Example 11

Comparative Example

The same polymer fibers were used as in example 1. A 1 meter sample of 3300 fibers was tied through the glass apparatus and placed under 100 g tension (~2 MPa). The fibers were then treated with 96% sulfuric acid for 4 hr at 120° C. The fibers were then cooled to room temperature, washed with 50% sulfuric acid, water, acetone and then dried. TGA analysis verified that the fibers were completely sulfonated. The sulfonated fiber tow was then placed into a tube furnace under 250 g (~4.5 MPa) tension and heated to 1150° C. over 5 hr under nitrogen. The tensile properties resulting from an average of ~15 filaments are provided in FIG. 1.

Example 12

Comparative Example

The polymer fibers used in this example are the same as those used in examples 6, 7, and 8. A 1 meter sample of 3300 fibers was tied through the glass apparatus and placed under 100 g tension (~2 MPa). The fibers were then treated with 96% sulfuric acid for 4 hr at 120° C. The fibers were then cooled to room temperature, washed with 50% sulfuric acid, water, acetone and then dried. TGA analysis verified that the fibers were completely sulfonated. The sulfonated fiber tow was then placed into a tube furnace under 500 g (~10 MPa) tension and heated to 1150° C. over 5 hr under nitrogen. The tensile properties resulting from an average of ~15 filaments are provided in FIG. 1.

What is claimed is:

1. Processes for preparing carbon fibers, comprising a) sulfonating a polymer with a sulfonating agent that comprises $SO_3$ in a halogenated solvent to form a sulfonated polymer;

b) treating the sulfonated polymer with a heated solvent, wherein the heated solvent is sulfuric acid at a temperature of at least 95° C.; and c) carbonizing the resulting product by heating it to a temperature of 500-3000° C.

2. Processes according to claim 1, wherein the concentration of the sulfonating agent in the halogenated solvent is from 0.01 to 24 moles/liter.

3. Processes according to claim 2, wherein the solvent is a fluorocarbon, a bromocarbon, a chlorocarbon, a chlorofluorocarbon, or combinations thereof.

4. Processes according to claim 3, wherein the solvent methylene chloride, 1,2-dichloroethane; 1,1,2,2-tetrachloroethane; or mixtures thereof.

5. Processes according to claim 1, wherein the polymer is a homopolymer that consists of polymers that are selected from polyethylene, polypropylene, polystyrene, and polybutadiene or wherein the polymer fiber is a copolymer of ethylene/octene copolymers, ethylene/hexene copolymers, ethylene/butene copolymers, ethylene/propylene copolymers, ethylene/styrene copolymers, ethylene/butadiene copolymers, propylene/octene copolymers, propylene/hexene copolymers, propylene/butene copolymers, propylene/styrene copolymers, propylene butadiene copolymers, styrene/octene copolymers, styrene/hexene copolymers, styrene/butene copolymers, styrene/propylene copolymers, styrene/butadiene copolymers, butadiene/octene copolymers, butadiene/hexene copolymers, butadiene/butene copolymers, butadiene/propylene copolymers, butadiene/styrene copolymers, or a combination of two or more thereof.

6. Processes according to claim 1, wherein the heated solvent is at a temperature of at least 100° C.

7. Processes according to claim 1, wherein the heated solvent is at 100-180° C.

8. Processes according to claim 1, wherein the sulfonation reaction is performed at a temperature of 0-90° C.

9. Processes according to claim 1, wherein the sulfonation is conducted under while the polymer is in the form of a polymer fiber, and the polymer fiber is under a tension of up to 22 MPa, the treatment with a heated solvent is conducted while the polymer fiber under a tension of up to 25 MPa, or carbonization is conducted while the polymer fiber is under a tension of up to 14 MPa.

10. Processes according to claim 1, wherein the sulfonation, the treatment with a heated solvent, and the carbonization are performed while the polymer is under a tension greater than 1 MPa.

11. Processes according to claim 9, wherein the tension during the carbonization step differs from that in the sulfonation step.

12. Processes according to claim 1, wherein the carbonization step is performed at temperatures of from 700-1,500° C.

13. Processes according to claim 1, comprising:

a) sulfonating a polyethylene containing polymer with $SO_3$ in a halogenated solvent, wherein the sulfonation reaction is performed at a temperature of from 0-90° C. to form a sulfonated polymer;

b) treating the sulfonated polymer with a heated solvent, wherein the temperature of the solvent is 100-180° C.; and c) carbonizing the resulting product by heating it to a temperature of 500-3000° C.;

wherein at least one of steps a), b) and c) is performed while the polymer fibers are under a tension of up to 14 MPa.

14. Processes according to claim 13, wherein the heated solvent is DMSO, DMF, or a mineral acid.

15. Processes according to claim 13, wherein the polyethylene containing polymer is a polyethylene homopolymer or polyethylene copolymers that comprise an ethylene/octene copolymer, an ethylene/hexane copolymer, an ethylene/butene copolymer, a mixture of one or more homopolymers and one or more polyethylene copolymers, or a combination of two or more polyethylene copolymers.

16. Processes according to claim 13, wherein the halogenated solvent is a chlorocarbon; and wherein steps a), b) and c) are performed while the polymer is under a tension greater than 1 MPa.

17. Processes according to claim 13 wherein the heated solvent is sulfuric acid at a temperature of 115-160° C.

18. Processes according to claim 1, wherein the sulfonation reaction with $SO_3$ in a halogenated solvent is run to 5-15% completion and then the sulfonation reaction is completed in the hot solvent treatment.

* * * * *